US008208666B2

(12) United States Patent
Gerkmann et al.

(10) Patent No.: US 8,208,666 B2
(45) Date of Patent: Jun. 26, 2012

(54) METHOD FOR DETERMINING UNBIASED SIGNAL AMPLITUDE ESTIMATES AFTER CEPSTRAL VARIANCE MODIFICATION

(75) Inventors: Timo Gerkmann, Bochum (DE); Rainer Martin, Bochum (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 352 days.

(21) Appl. No.: 12/684,147

(22) Filed: Jan. 8, 2010

(65) Prior Publication Data

US 2010/0177916 A1 Jul. 15, 2010

(30) Foreign Application Priority Data

Jan. 14, 2009 (EP) ..... 09000445

(51) Int. Cl.
*H04R 25/00* (2006.01)

(52) U.S. Cl. ..... 381/317; 381/312

(58) Field of Classification Search ..... 381/312–313, 381/316–318, 320

See application file for complete search history.

(56) References Cited

U.S. PATENT DOCUMENTS 7,499,554 B2 * 3/2009 Gustavsson ..... 381/317
7,747,031 B2 * 6/2010 Steinbuss ..... 381/317

OTHER PUBLICATIONS

Gradshteyn, et al., "Table of Integrals Series and Proudcts", 6th Ed., A. Jeffrey and D. Zwillinger, Ed. Academic Press, 2000.

Mauler et al., "An Analysis of Quefrency Selective Temporal Smoothing of the Ceptrum in Speech Enhancement" Institute of Communication Acoustics (IKA), Ruhr-Universitat Bochum, 44780 Bochum, Germany, 4 pages, 11th International Workshop on Acoustic Echo and Noise Control, Sep. 14-17, 2008, University of Washington, Seattle, WA, USA, XP-002561985.

Breithaupt et al., "A Novel a Priori SNR Estimation Approach Based on Selective Cepstro-Temporal Smoothing" Institute of Communication Acoustics (IKA), Ruhr-Universität Bochum, 44780 Bochum, Germany, 2008 IEEE, pp. 4897-4900.

Gerkmann et al., "Bias Compensation for Cepstro-Temporal Smoothing of Spectral Filter Gains" Institute of Communication Acoustics (IKA), Ruhr-Universität Bochum, 44780 Bochum, Germany, ITG-Fachtagung Sprachkomminikation Oct. 8-10, 2008 in Aachen, VDE Verlag, 5 pages.

Gerkmann et al., "On the Statistics of Spectral Amplitudes After Variance Reduction by Temporal Ceptrum Smoothing and Cepstral Nulling" IEEE Transactions on Signal Processing, vol. 57, No. 11, Nov. 2009, pp. 4165-4174.

* cited by examiner

*Primary Examiner* — Suhan Ni

(74) *Attorney, Agent, or Firm* — Laurence A. Greenberg; Werner H. Stemer; Ralph E. Locher

(57) ABSTRACT

A method for determining unbiased signal amplitude estimates ($|\widehat{S_k}|$) after cepstral variance modification of a discrete time domain signal (s(t)), wherein the cepstrally-modified spectral amplitudes ($|\widetilde{S_k}|$) of the discrete time domain signal (s(t)) are $\chi$-distributed with $2\tilde{\mu}$ degrees of freedom. A bias reduction factor (r) is determined using the equation $$r^2 = \frac{\mu}{\tilde{\mu}} e^{\psi(\tilde{\mu})-\psi(\mu)},$$

where $2\mu$ are the degrees of freedom of the $\chi$-distributed spectral amplitudes of the discrete time domain signal (s(t)) and $$\psi(x) = -0.5772 - \sum_{n=0}^{\infty}\left(\frac{1}{x+n} - \frac{1}{1+n}\right);$$

then the unbiased signal amplitude estimates ($|\widehat{S_k}|$) are determined by multiplying the cepstrally-modified spectral amplitudes ($|\widetilde{S_k}|$) with the bias reduction factor (r) according to the equation $|\widehat{S_k}|=r|\widetilde{S_k}|$. A method for speech enhancement and a hearing aid use the method for determining unbiased signal amplitude estimates ($|\widehat{S_k}|$) in order to offer the advantage of spectral modification, such as smoothing, of spectral quantities without affecting their signal power.

11 Claims, 3 Drawing Sheets

METHOD FOR DETERMINING UNBIASED SIGNAL AMPLITUDE ESTIMATES AFTER CEPSTRAL VARIANCE MODIFICATION

CROSS-REFERENCE TO RELATED APPLICATION

This application claims the priority, under 35 U.S.C. §119, of European patent application EP 090 00 445, filed Jan. 14, 2009; the prior application is herewith incorporated by reference in its entirety.

BACKGROUND OF THE INVENTION

Field of the Invention

The present invention relates to a method for determining unbiased signal amplitude estimates after cepstral variance modification of a discrete time domain signal. Moreover, the present invention relates to speech enhancement and hearing aids.

The description will make reference to the following document, which is hereby also incorporated by reference:

[1] I. S. Gradshteyn and I. M. Ryzhik, *Table of Integrals Series and Products,* 6th ed., A. Jeffrey and D. Zwillinger, Ed. Academic Press, 2000.

In many applications of statistical signal processing, a variance modification, for example a reduction, of spectral quantities derived from time domain signals, such as the periodogram, is needed. If a spectral quantity P is $\chi^2$-distributed with $2\mu$ degrees of freedom, $$p(P) = \frac{1}{\Gamma(\mu)}\left(\frac{\mu}{\sigma^2}\right)^{\mu} P^{\mu-1}\exp\left(-\frac{\mu}{\sigma^2}P\right), \tag{1}$$

it is well known that a moving average smoothing of P over time and/or frequency results in an approximately $\chi^2$-distributed random variable with the same mean $E\{P\}=\sigma^2$ and an increase in the degrees of freedom $2\mu$ that goes along with the decreased variance $\mathrm{var}\{P\}=\sigma^4/\mu$. The $\chi^2$-distribution holds exactly if the averaged values of P are uncorrelated. A drawback of smoothing in the frequency domain is that the temporal and/or frequency resolution is reduced. In speech processing this may not be desired as temporal smoothing smears speech onsets and frequency smoothing reduces the resolution of speech harmonics. It has recently been shown that reducing the variance of spectral quantities in the cepstral domain outperforms a smoothing in the spectral domain because specific characteristics of speech signals can be taken into account. In the cepstral domain speech is mainly represented by the lower cepstral coefficients that represent the spectral envelope, and a peak in the upper cepstral coefficients that represents the fundamental frequency and its harmonics. Therefore, a variance reduction can be applied to the remaining cepstral coefficients without distorting the speech signal. In general, a cepstral variance reduction (CVR) can be achieved by either selectively smoothing cepstral coefficients over time (temporal cepstrum smoothing—TCS), or by setting those cepstral coefficients to zero that are below a certain variance threshold (cepstral nulling—CN).

However, the application of an unbiased smoothing process in the cepstral domain leads to a bias in the spectral domain: the CVR does not only change the variance of a $\chi^2$-distributed spectral random variable P, but also its mean $E\{P\}=\sigma^2$. If $P=|S|^2$ is the periodogram of a complex zero-mean variable S for instance, changing $E\{P\}=E\{|S|^2\}$ changes the signal power of S.

SUMMARY OF THE INVENTION

It is accordingly an object of the invention to provide a method of determining unbiased signal amplitude estimates after cepstral variance modification which overcomes the above-mentioned disadvantages of the heretofore-known devices and methods of this general type and which minimizes this usually undesired side-effect of cepstral variance modification and which compensates for the bias in signal power/amplitude. It is a further object to provide a related speech enhancement method and a related hearing aid.

With the foregoing and other objects in view there is provided, in accordance with the invention, a method for determining unbiased signal amplitude estimates ($\widehat{|S_k|}$) after cepstral variance modification of a discrete time domain signal (s(t)), wherein cepstrally modified spectral amplitudes ($\widetilde{|S_k|}$) of the discrete time domain signal (s(t)) are $\chi$-distributed with 2 degrees of freedom. The method comprises the following method steps:

determining a cepstral variance ($\mathrm{var}\{s_q\}$) of cepstral coefficients ($s_q$) of the discrete time domain signal (s(t)) prior to cepstral variance modification;

determining a mean cepstral variance ($\overline{\mathrm{var}\{\tilde{s}_q\}}$) after cepstral variance modification of modified cepstral coefficients ($\tilde{s}_q$) using the cepstral variance ($\mathrm{var}\{s_q\}$) prior to cepstral variance modification;

determining the $2\tilde{\mu}$ degrees of freedom after the cepstral variance modification using the mean cepstral variance ($\overline{\mathrm{var}\{\tilde{s}_q\}}$);

determining a bias reduction factor (r) with the equation $$r^2 = \frac{\mu}{\tilde{\mu}} e^{\psi(\tilde{\mu})-\psi(\mu)}$$

where $2\mu$ are the degrees of freedom of the $\chi$-distributed spectral amplitudes of the discrete time domain signal (s(t)) and $$\psi(x) = -0.5772 - \sum_{n=0}^{\infty}\left(\frac{1}{x+n} - \frac{1}{1+n}\right); \text{ and}$$

determining the unbiased signal amplitude estimates ($\widehat{|S_k|}$) by multiplying the cepstrally-modified spectral amplitudes ($\widetilde{|S_k|}$) with the bias reduction factor (r) according to the equation $$\widehat{|S_k|} = r\widetilde{|S_k|}.$$

In other words, according to the present invention the above object is solved by a method for determining unbiased signal amplitude estimates after cepstral variance modification, e.g. reduction, of a discrete time domain signal, whereas the cepstrally-modified spectral amplitudes of said discrete time domain signal are $\chi$-distributed with $2\tilde{\mu}$ degrees of freedom.

According to a further preferred embodiment said cepstral variance ($\mathrm{var}\{s_q\}$) of cepstral coefficients ($s_q$) of said discrete time domain signal before cepstral variance modification is determined using the equation $$\mathrm{var}\{s_q\} = \frac{1}{K}\left(\zeta(2,\mu) + 2\sum_{m=1}^{M}\kappa_m\cos\left(m\frac{2\pi}{K}q\right)\right),$$

where K is the segment size, $$\zeta(z, \mu) = \sum_{n=0}^{\infty} \frac{1}{(\mu + n)^z},$$

M is a presetable natural number, $\kappa_m$ is the covariance between two log-periodogram bins $\log(|S_k|^2)$ that are m bins apart i.e.

$$\kappa_m = \mathrm{cov}\{\log(|S_k|^2), \log(|S_{k+m}|^2)\}$$

with k as the frequency coefficient index, and q is the cepstral coefficient index.

Furthermore $\kappa_m=0$ for m>0 (rectangular window).

Furthermore $\kappa_1=0.507$ and $\kappa_m=0$ for m>1 (approximated Hann window).

According to a further preferred embodiment said mean cepstral variance ($\overline{\mathrm{var}\{\tilde{s}_q\}}$) after cepstral variance modification of modified cepstral coefficients ($\tilde{s}_q$) is determined using the equation $$\overline{\mathrm{var}\{\tilde{s}_q\}} = \frac{1}{K/2-1} \sum_{q=1}^{K/2-1} \mathrm{var}\{s_q\} b_q,$$

where $\sqrt{b_q}$ is a presetable quefrency dependent modification factor.

Furthermore, $b_q \epsilon \{0, 1\}$ is the indicator function and sets those cepstral coefficients ($s_q$) to zero that are below a presetable variance threshold (cepstral nulling—CN).

According to a further preferred embodiment said mean cepstral variance ($\overline{\mathrm{var}\{\tilde{s}_q\}}$) after cepstral variance modification of modified cepstral coefficients ($\tilde{s}_q$) is determined using the equation $$\overline{\mathrm{var}\{\tilde{s}_q\}} = \frac{1}{K/2-1} \sum_{q=1}^{K/2-1} \mathrm{var}\{s_q\} \frac{1-\alpha_q}{1+\alpha_q},$$

where $\alpha_q$ is a presetable quefrency dependent modification factor (temporal cepstrum smoothing—TCS).

According to a further preferred embodiment said $2\tilde{\mu}$ degrees of freedom after cepstral variance modification are determined using the equation $$\zeta(2, \tilde{\mu}) = K\overline{\mathrm{var}\{\tilde{s}_q\}}.$$

With the above and other objects in view there is also provided, in accordance with the invention, a method for speech enhancement which incorporates the above method according to the present invention.

Furthermore, there is provided a hearing aid with a digital signal processor for carrying out a method according to the present invention.

Finally, there is provided a computer program product with a computer program which comprises software means for executing a method according to the present invention, if the computer program is executed in a control unit.

The invention offers the advantage of spectral modification, e.g. smoothing, of spectral quantities without affecting their signal power. The invention works very well for white and colored signals, rectangular and tapered spectral analysis windows.

The above described methods are preferably employed for the speech enhancement of hearing aids. However, the present application is not limited to such use only. The described methods can rather be utilized in connection with other audio devices such as mobile phones.

Other features which are considered as characteristic for the invention are set forth in the appended claims.

Although the invention is illustrated and described herein as embodied in method for determining unbiased signal amplitude estimates after cepstral variance modification, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF EXEMPLARY EMBODIMENTS OF THE INVENTION

Definition of Cepstral Coefficients

Figure 1:
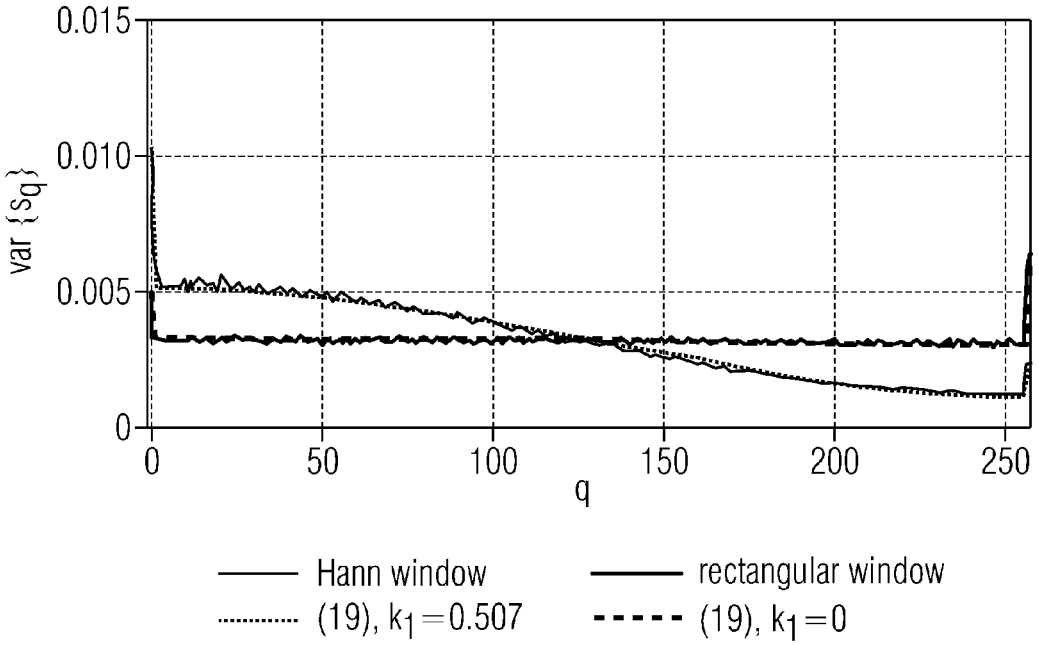
FIG. 1—The cepstral variance for a computer-generated white Gaussian time-domain signal analyzed with a non-overlapping rectangular analysis window $\omega_t$ (equation 2) and a Hann window with half-overlapping frames. The empirical variances are compared to the theoretical results in equation 19 with $\kappa_1=0$ for the rectangular window and $\kappa_1=0.507$ for the Hann window. Here K=512. The spectral coefficients are complex Gaussian distributed.

We consider the cepstral coefficients derived from the discrete short-time Fourier transform $S_k(I)$ of a discrete time domain signal s(t), where t is the discrete time index, k is the discrete frequency index, and I is the segment index. After segmentation the time domain signal is weighted with a window $\omega_t$ and transformed into the Fourier domain, as $$S_k(l) = \sum_{t=0}^{K-1} w_t s(lL + t) e^{-j2\pi kt/K}, \tag{2}$$

where L is the number of samples between segments, and K is the segment size. The inverse discrete Fourier transform of the logarithm of the periodogram yields the cepstral coefficients $$s_q(l) = \frac{1}{K}\sum_{k=0}^{K-1} \log(|S_k(l)|^2)e^{j2\pi kq/K}, \tag{3}$$

where q is the cepstral index, a.k.a. the quefrency index. As the log-periodogram is real-valued, the cepstrum is symmetric with respect to q=K/2. Therefore, in the following we will only discuss the lower symmetric part $q\in\{0, 1, \ldots, K/2\}$.

Statistical Properties of Log-Periodograms and Cepstral Coefficients

It is well known that for a Gaussian time signal s(t), the spectral coefficients $S_k$ are complex Gaussian distributed and the spectral amplitudes $|S_k|$ are Rayleigh distributed, i.e. $\chi$-distributed with two degrees of freedom for $k\in\{1, \ldots, K/2-1, K/2+1, \ldots, K-1\}$, and with one degree of freedom at $k\in\{0,K/2\}$. The $\chi$-distribution is given by $$p(|S_k|) = \frac{2}{\Gamma(\mu)}\left(\frac{\mu}{\sigma_{s,k}^2}\right)^{\mu}|S_k|^{2\mu-1}\exp\left(-\frac{\mu}{\sigma_{s,k}^2}|S_k|^2\right), \tag{4}$$

where $2\mu$ are the degrees of freedom and $\sigma^2_{s,k}$ is the variance of $S_k$. The distribution of the periodogram $P_k=|S_k|^2$ is then found to be the $\chi^2$-distribution, $$p(P_k) = \frac{1}{\Gamma(\mu)}\left(\frac{\mu}{\sigma_{s,k}^2}\right)^{\mu}P_k^{\mu-1}\exp\left(-\frac{\mu}{\sigma_{s,k}^2}P_k\right). \tag{5}$$

Even if the time domain signal is not Gaussian distributed, the complex spectral coefficients are asymptotically Gaussian distributed for large K. However, for segment sizes used in common speech processing frameworks, it can be shown that the complex spectral coefficients of speech signals are super-Gaussian distributed. In recent works it is argued that choosing $\mu<1$ in equation 4 may yield a better fit to the distribution of speech spectral amplitudes than a Rayleigh distribution ($\mu=1$). Therefore, results are derived for arbitrary values of $\mu$. To compute the variance of the cepstral coefficients we first derive the variance of the log-periodogram, $$\mathrm{var}\{\log(P_k)\}=E\{(\log(P_k))^2\}-(E\{\log(P_k)\})^2. \tag{6}$$

With [1, (4.352.1)], the expected value of the log-periodogram can be derived as $$E\{\log P_k\}=\psi(\mu)-\log(\mu)+\log(\sigma_{s,k}^2), \tag{7}$$

where $\Phi(\,)$ is the psi-function [1, (8.360)]. The first term on the right hand side of equation 6 can be derived using [1, (4.358.2)], as $$E\{(\log P_k)^2\}=(\psi(\mu)-\log(\mu)+\log(\sigma_{s,k}^2))^2+\zeta(2,\mu), \tag{8}$$

where $\zeta(\bullet,\bullet)$ is Riemann's zeta-function [1, (9.521.1)]. With equations 6, 7 and 8 the variance of the log-periodogram results in $$\mathrm{var}\{\log P_k\}=\zeta(2, \mu)=\kappa_0. \tag{9}$$

It can be shown that the covariance matrix of the cepstral coefficients can be gained by taking the two dimensional inverse Fourier transform of the covariance matrix of the log-periodogram as $$\mathrm{cov}\{s_{q_1}, s_{q_2}\} = \frac{1}{K^2}\sum_{k_2=0}^{K-1}\sum_{k_1=0}^{K-1} \mathrm{cov}\{\log(P_{k_1}), \log(P_{k_2})\}e^{j\frac{2\pi}{K}q_1k_1}e^{j\frac{2\pi}{K}q_2k_2}, \tag{10}$$

where $k_1, k_2\in\{0, \ldots, K-1\}$ are frequency indices, and $q_1, q_2\in\{0, \ldots, K/2\}$ are quefrency indices. For large K, we may neglect the fact that at $k\in\{0,K/2\}$ the variance $\mathrm{var}\{\log P_{0,K/2}\}=\zeta(2, \mu/2)$ is larger than for $k\in\{1, \ldots, K/2-1, K/2+1, \ldots, K-1\}$ where $\mathrm{var}\{\log P_k\}=\zeta(2, \mu)=\kappa_0$. If frequency bins are uncorrelated, i.e. $\mathrm{cov}\{\log P_{k1}, \log P_{k2}\}=0$ for $k_1\neq k_2$, the covariance matrix of the cepstral coefficients results in $$\mathrm{cov}\{s_{q_1}, s_{q_2}\}|_{rect.} = \begin{cases} \frac{1}{K}\kappa_0, & q_1 = q_2, q_1 \in \left\{1, \ldots, \frac{K}{2}-1\right\} \\ \frac{2}{K}\kappa_0, & q_1 = q_2, q_1 \in \left\{0, \frac{K}{2}\right\} \\ 0, & q_1 \neq q_2, \end{cases} \tag{11}$$

with $\kappa_0$ being defined in equation 9.

We now discuss the statistics of the log-periodogram and cepstral coefficients for tapered spectral analysis windows as used in many speech processing algorithms. The effect of tapered spectral analysis windows on the variance of the log-periodograms for the special case $\mu=1$ was previously considered, however here we additionally discuss the effect on the covariance matrix of the log-periodogram and the statistics of cepstral coefficients.

In equation 2 tapered spectral analysis windows $\omega_t$ result in a correlation of adjacent spectral coefficients, given by $$\rho_{k_1,k_2}^2 = \frac{|E\{S_{k_1}S_{k_2}^*\}|^2}{E\{|S_{k_1}|^2\}E\{|S_{k_2}|^2\}}. \tag{12}$$

For a Hann window, the correlation of the real valued zeroth and (K/2)th spectral coefficients with the adjacent complex valued coefficients results in $\mathrm{var}\{\mathrm{Re}\{S_k\}\}\neq\mathrm{var}\{\mathrm{Im}\{S_k\}\}$ for $k\in\{1, K/2-1, K/2+1, K-1\}$. As a consequence, $\mathrm{var}\{\log P_k\}$ will be slightly larger than $\zeta(2,\mu)$ for $k\in\{1, K/2-1, K/2+1, K-1\}$. As, for large K this hardly affects the cepstral coefficients, the effect is neglected here.

However, the general correlation of frequency coefficients $\rho$ greatly affects the variance of cepstral coefficients. The covariance matrix of the log-periodograms results in a K×K symmetric Toeplitz matrix defined by the vector $[\kappa_O, \kappa_1, \ldots, \kappa_{K/2}, \kappa_{K/2+1}, \kappa_{K/2}, \kappa_{K/2-1}, \ldots, \kappa_1]$. For large K, when $\kappa_m=0$ for $m>M$, $M\in K/2+1$, the covariance matrix of cepstral coefficients for correlated data is derived to be $$\mathrm{cov}\{s_{q_1}, s_{q_2}\} = \begin{cases} \frac{1}{K}\left(\kappa_0 + 2\sum_{m=1}^{M}\kappa_m\cos\left(m\frac{2\pi}{K}q_1\right)\right), & \text{for } q_1 = q_2, q_1 \in \left\{1, \ldots, \frac{K}{2}-1\right\} \\ \frac{2}{K}\left(\kappa_0 + 2\sum_{m=1}^{M}\kappa_m\cos\left(m\frac{2\pi}{K}q_1\right)\right), & \text{for } q_1 = q_2, q_1 \in \left\{0, \frac{K}{2}\right\} \\ 0, & \text{for } q_1 \neq q_2. \end{cases} \tag{13}$$

It can be seen that, also for correlated log-periodograms, cepstral coefficients are uncorrelated for large K.

To determine the parameters $\kappa_m$ we derive the covariance of two log-periodograms $\log(P_{k1})$ and $\log(P_{k2})$ with correlation $\rho$. For this, we use the bivariate $\chi^2$-distribution as $$p(P_{k_1}, P_{k_2}) = \frac{P_{k_1}^{\mu-1} P_{k_2}^{\mu-1}}{2^{2\mu+1}\sqrt{\pi}\,\Gamma(\mu)(1-\rho^2)^{\mu}} e^{-\frac{P_{k_1}+P_{k_2}}{2(1-\rho^2)}} \sum_{n=0}^{\infty} (1+(-1)^n)\left(\frac{\rho}{1-\rho^2}\right)^n \frac{\Gamma\left(\frac{n+1}{2}\right)}{n!\,\Gamma\left(\frac{n}{2}+\mu\right)} P_{k_1}^n P_{k_2}^n, \tag{14}$$

with $\Gamma(\,)$ the complete gamma function [1, (8.31)]. Note that the infinite sum in equation 14 can also be expressed in terms of the hypergeometric function. With [1, (4.352.1)] and [1, (3.381.4)] we find $$\begin{aligned}\operatorname{cov}\{\log(P_{k_1}), \log(P_{k_2})\} &= E\{\log(P_{k_1})\log(P_{k_2})\} - E\{\log(P_{k_1})\}E\{\log(P_{k_2})\} \\ &= \sum_{n=0}^{\infty} A(n, \mu, \rho_{k_1,k_2})(B(n, \mu, \rho_{k_1,k_2}))^2 - \left(\sum_{n=0}^{\infty} A(n, \mu, \rho_{k_1,k_2})B(n, \mu, \rho_{k_1,k_2})\right)^2,\end{aligned} \tag{15}$$

where $$A(n, \mu, \rho_{k_1,k_2}) = \frac{(1-\rho_{k_1,k_2}^2)^{\mu}}{2\sqrt{\pi}\,\Gamma(\mu)}(1+(-1)^n)2^n\rho_{k_1,k_2}^n \frac{\Gamma\left(\frac{n+1}{2}\right)\Gamma\left(\frac{n}{2}+\mu\right)}{n!}, \tag{16}$$

$$B(n, \mu, \rho_{k_1,k_2}) = \psi\left(\mu+\frac{n}{2}\right) + \log\left(2(1-\rho_{k_1,k_2}^2)\right), \tag{17}$$

and $\rho^2_{k1,\,k2}$ defined in equation 12. With equation 15, the covariance of neighboring log-periodogram bins can be determined. It can be shown that for a Hann window and $\sigma^2_{s,\,k}=\sigma^2_{s,\,k+1}\approx\sigma^2_{s,\,k+2}$, the normalized correlation results in $\rho^2_{k,\,k+1}=4/9$ and $\rho^2_{k,\,k+2}=1/36$. Hence, for a Hann window and $\mu=1$ we have $\kappa_1=0.507$ and $\kappa_2=0.028$. As $\kappa_2<<\kappa_1$, the influence of $\kappa_2$ can be neglected. We thus assume that only adjacent frequency bins are correlated. The resulting covariance matrix of the log-periodograms is a K×K symmetric Toeplitz matrix defined by the vector $[\kappa_0, \kappa_1, 0, \ldots, 0, \kappa_1]$. The sub diagonals with the value $\kappa_1$ result in an additional cosine term in the covariance matrix of the cepstral coefficients, as $$\operatorname{cov}(s_{q_1}, s_{q_2}\}|_{Hann} = \begin{cases} \frac{1}{K}\left(\kappa_0 + 2\kappa_1\cos\left(\frac{2\pi}{K}q_1\right)\right), & q_1 = q_2,\ q_1 \in \left\{1, \ldots, \frac{K}{2}-1\right\} \\ \frac{2}{K}\left(\kappa_0 + 2\kappa_1\cos\left(\frac{2\pi}{K}q_1\right)\right), & q_1 = q_2,\ q_1 \in \left\{0, \frac{K}{2}\right\} \\ 0, & q_1 \neq q_2. \end{cases} \tag{18}$$

Therefore, the variance of the cepstral coefficients is given by $$\operatorname{var}\{s_q\} = (\zeta(2, \mu) + 2\kappa_1\cos(2\pi q/K))/K. \tag{19}$$

with $\kappa_1=0.507$ for the Hann window and $\kappa_1=0$ for the rectangular window.

The cepstral variance for $\mu=1$ and the rectangular window ($\kappa_1=0$) or the Hann window ($\kappa_1=0.507$) are compared in FIG. 1 where we also show empirical data. It is obvious that equation 18 provides an excellent fit for both the rectangular window and the Hann window. The fact that we set $\kappa_2=0$ for the Hann window is thus shown to be a reasonable approximation. As the additional cosine-terms in equations 13 and 19 have zero mean, the mean cepstral variance $$\overline{\operatorname{var}\{s_q\}} = \frac{1}{K/2-1}\sum_{q=1}^{K/2-1} \operatorname{var}\{s_q\} = \zeta(2, \mu)/K \tag{20}$$

equals the cepstral variance of a rectangular window for arbitrary spectral correlation and thus independent of the chosen analysis window $\omega_t$. Therefore, the mean variance of the cepstral coefficients and the degrees of freedom $2\mu$ are directly related.

Statistical Properties After Cepstral Variance Reduction

We approximate the distribution of spectral amplitudes after CVR by the parametric $\chi$-distribution. As shown in the experiments below, this approximation is fully justified for uncorrelated spectral bins, and gives sufficiently accurate results for spectrally correlated bins. With this assumption we see that due to equation 20 a CVR increases the parameter $\mu$ of the $\chi$-distribution. Then, due to equation 7, changing $\mu$ also changes the spectral power $\rho^2_{s,\,k}$. Hence, a variance reduction in the cepstral domain results in a bias in the spectral power that can now be accounted for. In the following, we denote parameters after CVR by a tilde. We will discuss CN and TCS separately.

If we set a certain number of cepstral coefficients in $q\in\{1, \ldots, K/2-1\}$ to zero (CN), the mean variance after CVR can be determined as $$\overline{\operatorname{var}\{\tilde{s}_q\}} = \frac{1}{K/2-1}\sum_{q=1}^{K/2-1} \operatorname{var}\{s_q\}b_q, \tag{21}$$

where the indicator function $b_q\in\{0, 1\}$ sets those cepstral coefficients to zero that are below a certain variance threshold.

For TCS the cepstral coefficients are recursively smoothed over time with a quefrency-dependent smoothing factor $\alpha_q$ $$\tilde{s}_q(l) = \alpha_q\tilde{s}_q(l-1) + (1-\alpha_q)\, s_q(l). \tag{22}$$

Assuming that successive signal segments are uncorrelated, the mean cepstral variance can be determined by $$\overline{\operatorname{var}\{\tilde{s}_q\}} = \frac{1}{K/2-1}\sum_{q=1}^{K/2-1} \operatorname{var}\{s_q\}\frac{1-\alpha_q}{1+\alpha_q}, \tag{23}$$

which is also a reasonable assumption for Hann analysis windows with 50% overlap. For higher signal segment correlation, the mean variance after CVR $\overline{\operatorname{var}\{\tilde{s}_q\}}$ can be measured offline for a fixed set of recursive smoothing constants $\alpha_q$. For a given $\mu$ of the spectral amplitudes before CVR, the cepstral variance can be determined via equation 19 and thus the mean cepstral variance after CVR $\overline{\operatorname{var}\{\tilde{s}_q\}}$ via equation 21 or equation 23. With a known mean cepstral variance, the parameter $\tilde{\mu}$ can be determined using $$\zeta(2, \tilde{\mu}) = K\overline{\operatorname{var}\{\tilde{s}_q\}}, \tag{24}$$

where $2\tilde{\mu}$ are the degrees of freedom after CVR.

The spectral power bias $\sigma_{s,k}^2/\tilde{\sigma}_{s,k}^2$ can then be determined using equation 7, as $$\log(\sigma_{s,k}^2/\tilde{\sigma}_{s,k}^2) = E\{\log(|S_k|^2)\} - \psi(\mu) + \log(\mu) - \left(E\{\log(|\tilde{S}_k|^2)\} - \psi(\tilde{\mu}) + \log(\tilde{\mu})\right). \tag{25}$$

Note that a change in signal power due to a reduction of spectral outliers shall not be compensated. We assume that the expected value of the log-periodogram of the desired signal stays unchanged after CVR. Hence $E\{\log(|Sk|^2)\}$ and $E\{\widetilde{\log(|S_k|^2)}\}$ cancel out in equation 25 and the bias in spectral power can be compensated by the frequency independent factor $$r^2 = \sigma_{s,k}^2/\tilde{\sigma}_{s,k}^2 = \frac{\mu}{\tilde{\mu}} e^{\psi(\tilde{\mu})-\psi(\mu)} \tag{26}$$

that is applied to all spectral bins as $$\widehat{|S_k|} = \widetilde{|S_k|}. \tag{27}$$

Therefore, we obtain cepstrally-smoothed spectral amplitudes $\widehat{|S_k|}$ with reduced cepstral variance that are approximately $\chi$-distributed according to equation 4 with $2\tilde{\mu}$ degrees of freedom and have the correct signal power.

Figure 2A:
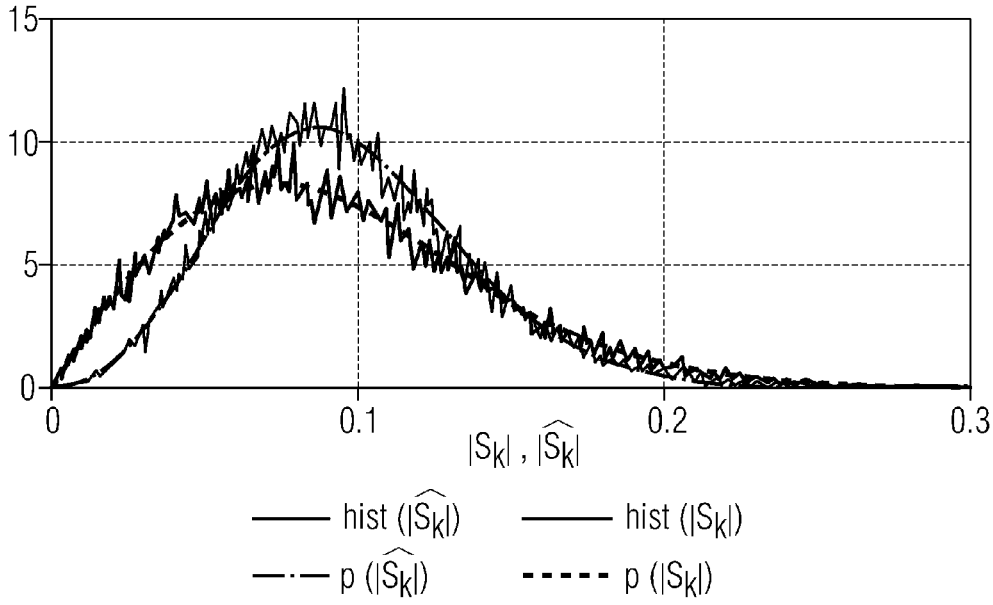
FIG. 2—Histogram and distribution for spectral bin k=20 and K=512 before and after TCS. The analysis was done using computer generated pink Gaussian noise, non-overlapping rectangular windows (2A) and 50% overlapping Hann-windows (2B). The recursive smoothing constant in equation 22 is chosen as $\alpha_q=0.4(1+\cos(2\pi q/K))$.
Figure 2B:
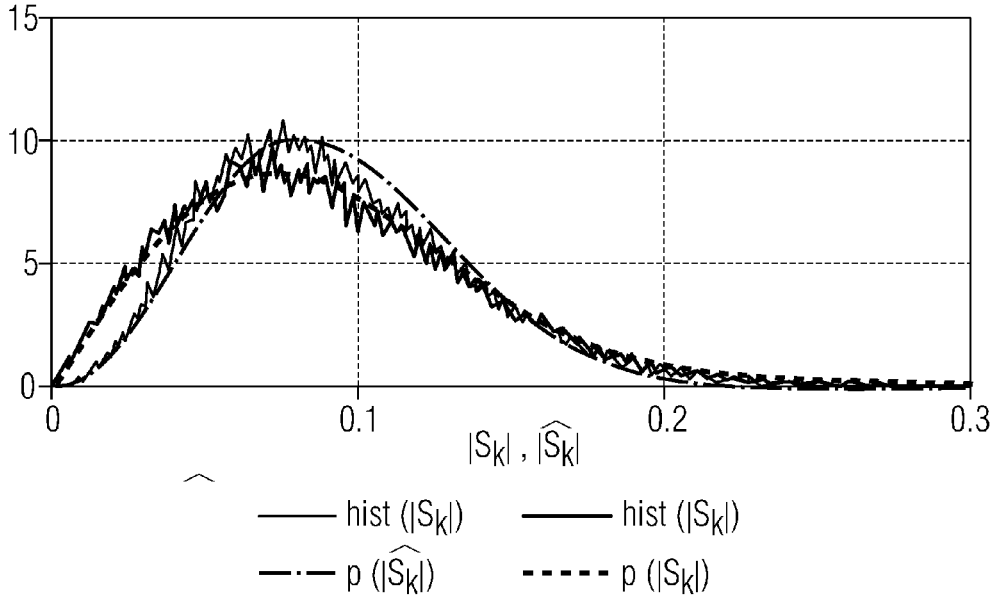
Figure 3A:
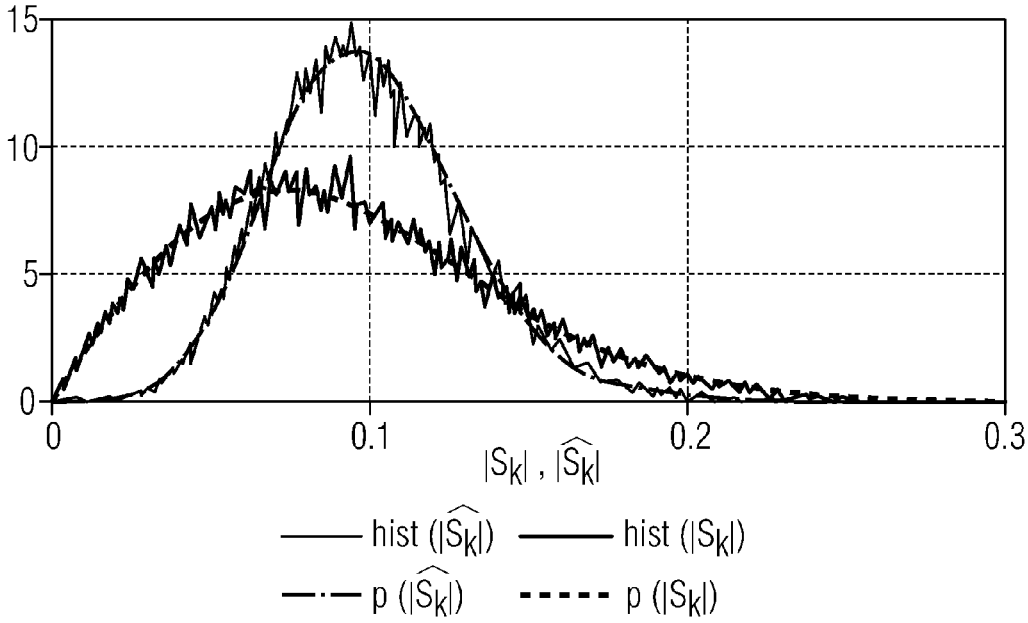
FIG. 3—Histogram and distribution for spectral bin k=20 and K=512 before and after a CN. The analysis was done using computer generated pink Gaussian noise, non-overlapping rectangular windows (3A) and 50% overlapping Hann-windows (3B). Cepstral coefficients q>K/8 are set to zero.
Figure 3B:
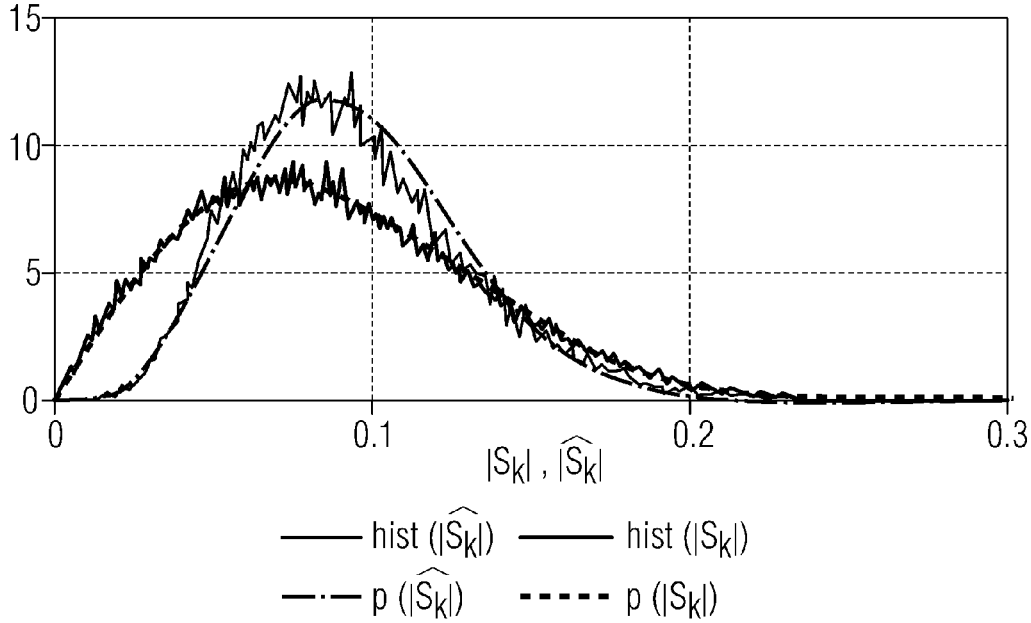

In FIG. 2 and FIG. 3 it is shown that above procedure works very well to estimate the degrees of freedom and the signal power of spectral amplitudes after CVR. For this we create pink Gaussian noise, apply a CVR, estimate the degrees of freedom and compensate for the signal power bias. An excellent match of the observed histogram and the derived distribution before and after TCS and CN for the rectangular window and a good match for the overlapping Hann window is shown. For the rectangular window, the deviation between the power before CVR $E\{|Sk|^2\}$ and the power after CVR and bias compensation $E\{\widehat{|S_k|}^2\}$ is less than 1%, while for the Hann window the error is approximately 4%. These errors are representative for typical speech processing applications where the lower cepstral coefficients are not or little modified. The larger error for Hann windows can be accounted to the fact that the $\chi$-distribution only approximates the true distribution for correlated coefficients.

Mean of the Cepstrum

In the following results are generalized where $\mu=1$ is assumed. Due to the linearity of the inverse Fourier transform $IDFT\{\cdot\}$ and equation 7, the mean value of the cepstral coefficients defined by equation 3 is given by $$\begin{aligned} E\{s_q\} &= IDFT\{E\{\log P_k\}\} \\ &= IDFT\{\log\sigma_{s,k}^2) - IDFT\{\log\mu_k - \psi(\mu_k)\} \\ &= IDFT\{\log\sigma_{s,k}^2\} - \varepsilon_q. \end{aligned} \tag{28}$$

Therefore, even for white signals, when $\sigma^2_{s,k}$ is constant over frequency, the mean of the cepstral coefficients is not zero for q>0 but $-\epsilon_q$. When $\mu_k$ is $\mu/2$ for $k\epsilon\{(0, K/2\})$, and $\mu$ else, the deviation $\epsilon_q$ results in $$\varepsilon_q = IDFT\{\log\mu_k - \psi(\mu_k)\} = \begin{cases} \frac{K-2}{K}(\log\mu - \psi(\mu)) + \frac{2}{K}\left(\log\frac{\mu}{2} - \psi\left(\frac{\mu}{2}\right)\right), & \text{if } q = 0 \\ \frac{2}{K}\left(\log\frac{\mu}{2} - \psi\left(\frac{\mu}{2}\right)\right) - \frac{2}{K}(\log\mu - \psi(\mu)), & \text{if } q \text{ odd} \\ 0, & \text{if } q \text{ even} \end{cases} \tag{29}$$

If $\mu_k=\mu$ is constant for all k the deviation results in $\epsilon_q=\log(\mu)-\phi(\mu)$ for q=0 and $\epsilon_q=0$ else. Because in the CVR method proposed in the literature certain cepstral coefficients are set to zero better performance is achieved when the cepstrum actually has zero mean for white signals. Such an alternative definition of the cepstrum is given by $\tilde{s}_q=s_q+\epsilon_q$ However, as typically $\epsilon_q^2 \ll \mathrm{var}\{s_q\}$ for q>0, the influence of the mean bias $\epsilon_q$ given in equation 29 is of minor importance. For a temporal cepstrum smoothing zero mean cepstral coefficients are neither assumed nor required.

The invention claimed is:

1. A method for determining unbiased signal amplitude estimates after cepstral variance modification of a discrete time domain signal, wherein cepstrally modified spectral amplitudes of the discrete time domain signal are $\chi$-distributed with $2\tilde{\mu}$ degrees of freedom, the method which comprises:

determining a cepstral variance of cepstral coefficients of the discrete time domain signal prior to cepstral variance modification;

determining a mean cepstral variance after cepstral variance modification of modified cepstral coefficients using the cepstral variance prior to cepstral variance modification;

determining the $2\tilde{\mu}$ degrees of freedom after the cepstral variance modification using the mean cepstral variance;

determining a bias reduction factor with the equation $$r^2 = \frac{\mu}{\tilde{\mu}} e^{\psi(\tilde{\mu})-\psi(\mu)}$$

where $2\mu$ are the degrees of freedom of the $\chi$-distributed spectral amplitudes of the discrete time domain signal (s(t)) and $$\psi(x) = -0.5772 - \sum_{n=0}^{\infty}\left(\frac{1}{x+n} - \frac{1}{1+n}\right); \text{ and}$$

determining the unbiased signal amplitude estimates by multiplying the cepstrally-modified spectral amplitudes with the bias reduction factor according to the equation $$\widehat{|S_k|} = \widetilde{|S_k|};$$

where $\widehat{|S_k|}$ are the unbiased signal amplitude estimates, $\widetilde{|S_k|}$ are the cepstrally-modified spectral amplitudes, and r is the bias reduction factor.

2. The method according to claim 1, which comprises determining the cepstral variance of cepstral coefficients of the discrete time domain signal prior to cepstral variance modification using the equation $$\mathrm{var}\{s_q\} = \frac{1}{K}\left(\zeta(2,\mu) + 2\sum_{m=1}^{M}\kappa_m \cos\left(m\frac{2\pi}{K}q\right)\right),$$

where $\mathrm{var}\{s_q\}$ is the cepstral variance, K is a segment size, $$\zeta(z,\mu) = \sum_{n=0}^{\infty}\frac{1}{(\mu+n)^z},$$

M is a presetable natural number, $\kappa_m$ is a covariance between two log-periodogram bins $\log(|S_k|^2)$ that are m bins apart, $s_q$ are the cepstral coefficients, and q is a cepstral coefficient index.

3. The method according to claim 2, wherein $\kappa_m=0$ for m>0.

4. The method according to claim 2, wherein $\kappa_1=0.507$ and $\kappa_m=0$ for m>1.

5. The method according to claim 1, which comprises determining the mean cepstral variance ($\overline{\mathrm{var}\{\tilde{s}_q\}}$) after cepstral variance modification of modified cepstral coefficients ($\tilde{s}_q$) using the equation $$\overline{\mathrm{var}\{\tilde{s}_q\}} = \frac{1}{K/2-1}\sum_{q=1}^{K/2-1}\mathrm{var}\{s_q\}b_q,$$

where $\overline{\mathrm{var}\{\tilde{s}_q\}}$ is the mean cepstral variance, $\tilde{s}_q$ the modified cepstral coefficients, and $\sqrt{b_q}$ is a presetable quefrency dependent modification factor.

6. The method according to claim 5, wherein $b_q \in \{0,1\}$ is an indicator function configured to set those cepstral coefficients to zero that are below a presetable variance threshold.

7. The method according to claim 1, which comprises determining the mean cepstral variance after cepstral variance modification of modified cepstral coefficients using the equation $$\overline{\mathrm{var}\{\tilde{s}_q\}} = \frac{1}{K/2-1}\sum_{q=1}^{K/2-1}\mathrm{var}\{s_q\}\frac{1-\alpha_q}{1+\alpha_q},$$

where $\overline{\mathrm{var}\{\tilde{s}_q\}}$ the mean cepstral variance, $\tilde{s}_q$ are the modified cepstral coefficients, and $\alpha_q$ is a presetable quefrency-dependent modification factor.

8. The method according to claim 1, which comprises determining the $2\tilde{\mu}$ degrees of freedom after cepstral variance modification using the equation $$\zeta(2,\tilde{\mu}) = K\overline{\mathrm{var}\{\tilde{s}_q\}}.$$

9. A method for speech enhancement, which comprises carrying out the method according to claim 1.

10. A hearing aid, comprising a digital signal processor programmed to carry out the method according to claim 1.

11. A computer program product with a computer program comprising executable software instructions for executing the method according to claim 1 when the computer program is executed in a control unit.

* * * * *